United States Patent [19]

Uldricks et al.

[11] 3,998,432

[45] Dec. 21, 1976

[54] AIR OPERATED LOAD BALANCING HOIST

[75] Inventors: Charles D. Uldricks, Newbury Park; Alexander Enrico Kiralfy, Los Angeles, both of Calif.

[73] Assignee: Charles D. Uldricks, Newbury Park, Calif.

[22] Filed: Jan. 2, 1976

[21] Appl. No.: 646,157

[52] U.S. Cl. ..... 254/168; 254/189; 251/347

[51] Int. Cl.[2] ..... B66D 1/00

[58] Field of Search ..... 254/168, 167, 172, 173 R, 254/186 R, 150 R, 150 FH, 188, 189, 148; 251/340, 347, 344, 353; 137/115, 116.3, 118.5; 294/64 R; 91/445, 447; 214/1 BB, 658

[56] References Cited

UNITED STATES PATENTS

| | | | |
|---|---|---|---|
| 2,902,183 | 9/1958 | Dodge | 254/189 |
| 3,384,350 | 5/1968 | Powell | 254/168 |
| 3,502,535 | 3/1970 | Bongers et al. | 254/189 |

*Primary Examiner*—Frank E. Werner
*Assistant Examiner*—Kenneth Noland
*Attorney, Agent, or Firm*—William H. Pavitt, Jr.

[57] ABSTRACT

A piston is provided to operate in a horizontally disposed cylinder, into one end of which cylinder, air may be admitted under pressure and through the other end of which cylinder, a piston rod, connected to the piston to move therewith, slidably extends to support a plurality of sprockets at the outer end of the piston rod. Additional sprockets are mounted outside the end wall of the cylinder through which the piston rod slidably extends, and a chain, one end of which is fixedly anchored near such cylinder wall, passes back and forth between and around the piston rod-supported sprockets and the stationary sprockets. The chain finally passes around a further sprocket disposed below the cylinder from which the other end of the chain then depends downwardly. The downwardly pending end of the chain may be connected with the upper end of an elongated element, the lower end of which is provided with means for attachment to an article to be hoisted. The last said element is provided with annular grooves. About this element over these grooves is provided a sleeve-like valve which is spring-biased to a position which is intermediate an upper position to which the sleeve-like valve may be manually shifted by an upward lifting motion, and a lower position to which the valve may similarly be shifted by downward pressure applied manually.

15 Claims, 7 Drawing Figures

36
34
12
35
30
10a
64
2
139
14
38
32
44
46
16
58
52
61
3
28
11
60
52
24
38
20
48
22
164
40
20
23
42
18
20a
50
25
166
62
50
38'
56
54
14'
58a
54
94'
26
70
79
58b
61
3
94
10b
86
80
68
76
2
78
90
74
74a
88
82
74b
92
61
72
100a
122
121
120a
92
102
73
104
82
100b
126
120
121
116
100c
72a
96

14
150
140
152
28
142
139
144
146
141
148
28a
140a

25'
25c
25m
25s
25d
25a
25o
25g
25e
25n
25j
25p
25r
25b
25k
25t
25l
25f
25g
25i
25h

AIR OPERATED LOAD BALANCING HOIST

BACKGROUND OF THE INVENTION

1. Field Of The Invention

This invention relates to apparatus for raising and lowering articles having weights in excess of those which can be conveniently handled by the average workman and, particularly, to balancing apparatus which is operated by air pressure admitted to a cylinder to move a piston in the cylinder to accomplish the raising and lowering of the article.

2. Description Of The Prior Art

Hoists operated by air pressure have been devised and utilized for many years and, within the past fifteen or twenty years, there have issued a number of United States patents which disclose a number of different concepts relating to the employment of air pressure for accomplishing the raising and lowering of weighted articles or loads. Thus, for example, one may vote the different approaches taken to accomplish this objective by the different inventors of the following U.S. Pat. Nos.:

| | |
|---|---|
| R. E. Smith et al | 2,924,430 |
| Lauren J. McKendrick | 3,552,720 |
| Sean McKendrick | 3,573,686 |
| William Workman, Jr. et al | 3,758,079 |
| R. E. Geiger et al | 3,526,388 |
| J. D. Bottje et al | 2,939,431 |
| E. R. Powell | 3,260,508 |
| Lauren J. McKendrick | 3,773,296 |
| Edgar R. Powell | 3,656,715 |
| Charles W. Stone et al | 3,791,627 |
| Charles W. Stone | 3,756,563 |
| Arthur B. Carlson et al | 3,747,886 |
| Robert W. Watson | 3,880,393 |
| J. D. Bottje et al | 2,901,219 |
| Lauren J. McKendrick | 3,856,266 |

In addition, other patents have disclosed valve devices to be utilized with fluid actuated balancing hoists, such as, for example, that issued to Emmanual G. Spiradakis, U.S. Pat. No. 3,554,091, and that issued to Robert E. Geiger, U.S. Pat. No. 3,547,150.

Currently, there are several companies which offer load balancer hoists of various types as, for example, D. W. Zimmerman Manufacturing, Inc. of Madison Heights, Mich.; the Balancer Division of Conco, Inc., Mendota, Ill.; The Platz Company, Inc. of Detroit, Mich.

Prior art hoists, however, have been subject to one or more of the following criticisms:

1. Most hoists do not dispose the control close to the article being lifted, with the result that the operator must move at least one of his hands some distance from the article being lifted or raised in order to accomplish further raising or lowering of the article. Where the operator may need two hands properly to seat or otherwise dispose the article being handled, the remote location of the control in prior art devices constitutes a decided disadvantage.

2. The controls of certain of the prior art devices must be readjusted when they are to handle substantially different weighted loads within the load range capacity of the hoist.

3. Most of the hoists are quite expensive to construct and, hence, cannot be sold at low prices--even where the hoist load requirements may be relatively small, such as, for example, less than 500 pounds; with the result that many small shops and industrial facilities which could use a relatively inexpensive effective air operated load balancer, simply cannot afford to purchase currently available hoists which are on the market.

4. Because those hoists which might be used to raise and lower lesser loads (such as those below 500 pounds) employ cables in their mechanism, the thickness required of such cables has made it difficult for hoist designers to devise a small unit which can operate effectively to provide the desired attenuation of control in raising and lifting the loads.

5. Further, where cables are utilized, there is always a tendency for the cable to spiral with its load. This can endanger the operator as well as render it possible for the load to strike a structure in the vicinity of which the load is being raised or lowered with possible damage to the load and/or structure.

6. Certain of the prior art hoists raise or lower their loads very quickly in response to their respective controls. Because of the fact that such hoists are normally utilized to raise and lower fairly heavy loads, as for example, between 100 and 500 pounds, an erroneous control movement by the operator, or a lack of an adequate fail-safe in the hoist, can produce a tragic accident. With certain of the present hoists, this can easily occur when the control is placed in the hands of an unskilled or inexperienced operator. The operation of presently available hoists, therefore, is seldom, if ever, committed to the hands of such an operator. Such a hoist, therefore, may simply not be utilized at all if a high-priced skilled operator is not available and when it is used, the labor cost of the operation naturally increases.

7. After a load has been raised or lowered and positioned by providing a certain quantity of air under pressure in the lifting cylinder, or venting a certain amount of pressurized air, the load will tend to remain at the level to which it has been raised or lowered. In this respect, the load may be in balance so that it will hold its position despite minor pressure changes in the cylinder of, for example, 1 or 2 pounds, plus or minus, simply because of the friction in the system. If the load should be raised slightly by an outside force, such, for example, as the operator's hands lifting the load, or the load pushed down by such a force, so long as any change thereby occasioned in the air pressure in the cylinder does not exceed the one or two pounds required to overcome the friction in the system, the load will tend to remain in balance in its new thus-forced disposition. In many instances it is desirable for the operator to be able to change the load level by applying a slight lift or pushing down on the load so that he may fit the load into some particular area or machine and be able to do so without having to operate the control valve which, if sensitive, could raise or lower the load too rapidly, with the possibility of damaging the load or injuring the operator. Prior art hoists, however, have either provided so much frictional resistance as to resist any change being accomplished in the load level by any such outside force.

8. The air valves provided in prior art hoists for controlling the raising or lowering of loads have generally been of a complex nature in order to obtain a sufficient flow of air into the lifting air cylinder. But, despite such complexity in the nature of these valves, they appear to have been lacking in ability to control the air flow in a variable degree according to the amount of force supplied by the operator to the control valve and hence the raising or lowering of the load.

There has existed, therefore, prior to the present invention, a need for a relatively inexpensive load balancer which has built-in safety factors and operates so simply that any person can control it with a minimum of training and explanation. Further, any such load balancer should not require valve or other adjustments when different weighted loads, within the load capacity of the hoist, are being lowered or lifted, and the control should be located as close as possible to the article or other work piece which is being made the subject of the hoisting action, so that the load can be completely raised or lowered or otherwise controlled with only one hand of the operator.

SUMMARY OF THE INVENTION

The present invention obviates the criticism of the prior art load balancing air hoists in that it can be made and sold at a relatively inexpensive price, has built-in safety factors, is compact, is not subject to cable spiralling, and has a simple and effective control located immediately over the article or work piece which is being lifted. It can, moreover, be operated by a connection to the average shop compressor which provides as much as 80 pounds psi of air pressure.

The present invention contemplates employing an air-operated piston cylinder combination, preferably disposed in a horizontal orientation with air being admitted or bled from one end of the cylinder, and having a piston rod attached to the piston slidably extending through the opposite end of the cylinder. The outer end of the piston rod carries at least one end and, preferably a plurality of rotatable sprockets or spools. At least one and, preferably, a plurality of other rotatable sprockets or spools are fixedly mounted on or adjacent the end of the cylinder through which piston rod slidably extends. A chain, one end of which may be secured either to the piston cylinder, or to an element on the outer end of the piston rod which carries at least one sprocket or spool, passes back and forth between the sprockets and spools carried by the piston rod and movable therewith, and those sprockets or spools which are fixedly mounted on the cylinder, the chain terminating in an end which depends below the cylinder. Thus, any movement of the piston results in a raising or lowering of the depending end of the chain. Such movement of the piston is accomplished by admitting or bleeding air from the end of the cylinder which is opposite that through which the piston rod slidably extends. Attenuated control of the air admitted into, and the bleed of air from the cylinder is accomplished by, a sleeve-type valve having an elongated core with full load carrying capacity. This core is secured to and interposed between both the depending end of the chain and means attachable to the load to be carried. The sleeve-like valve which surrounds the core is provided with a handle grip and air line connections between the source of air under pressure on the one hand, and the end wall of the cylinder on the other. Internal passages are provided in the valve sleeve and the valve core so that any shifting of the valve sleeve upwardly relative to the core results in placing the air line to the cylinder in communication with the air pressure source, thereby forcing the piston to the opposite end of the cylinder and the depending end of the chain, to be raised. Correspondingly, any shifting of the valve sleeve downwardly relative to its core cuts off communication between the air pressure source and the cylinder and, moreover, places the line to the cylinder in communication with the atmosphere, thereby bleeding off the pressurized air in the cylinder. Spring means are provided at each end of the valve sleeve to maintain the valve in an intermediate position whereby air from the pressure source is not in communication with the cylinder, nor is the air line from the cylinder vented to the atmosphere. In this intermediate posture of the valve, the load remains stationary. Hence, the sleeve-like valve is disposed directly over the load at its point of attachment to the valve core. It will be readily appreciated that both of the operator's hands may be kept very close to the work load, even when one of the hands may be operating the sleeve-like valve, thereby the operator may better control the disposition of the load while he may be raising or lowering it, depending upon the movement of one of his hands on the valve sleeve.

The control valve of the present invention may be seen to be of simple design and relatively inexpensive to fabricate. Moreover, because of its unique construction, this valve enables the operator to effect a variable rate of control according to the amount of movement which he imparts to the slidable valve sleeve. Such resultant variable rate of control is accomplished by the design of the passages in the valve core whereby a small amount of air may be passed to or from the lifting air cylinder, or the amount of air may be increased to a full unrestricted flow by the operator shifting the valve sleeve fully in either axial direction. Thus, by the design of the core passages in the valve, such varying rate of control is accomplished in a very simple manner.

While prior patents have suggested the use of cables extending over pulleys, some of which are located on a piston rod to be movable therewith, and others, stationary and disposed in the vicinity of the outside of the piston cylinder wall, no prior art hoists or load balancers have employed a chain and sprocket arrangement with some sprockets being carried by the outer end of a piston rod and other sprockets being disposed in fixed positions on or adjacent to the outside of the piston cylinder wall.

Among the advantages of the chain and sprocket arrangment of the present invention are the avoidance of spiralling of the load and a much better attenuation of control of the upward and downward movement of the load in response to manual shifting of the sleeve-like valve member located directly over the load. In addition, the size of the unit may be reduced substantially over the size of pulley-cable hoists with resulting greater convenience in handling and reduction in its cost of manufacture.

DESCRIPTION OF THE PREFERRED EMBODIMENT

Figure 1:
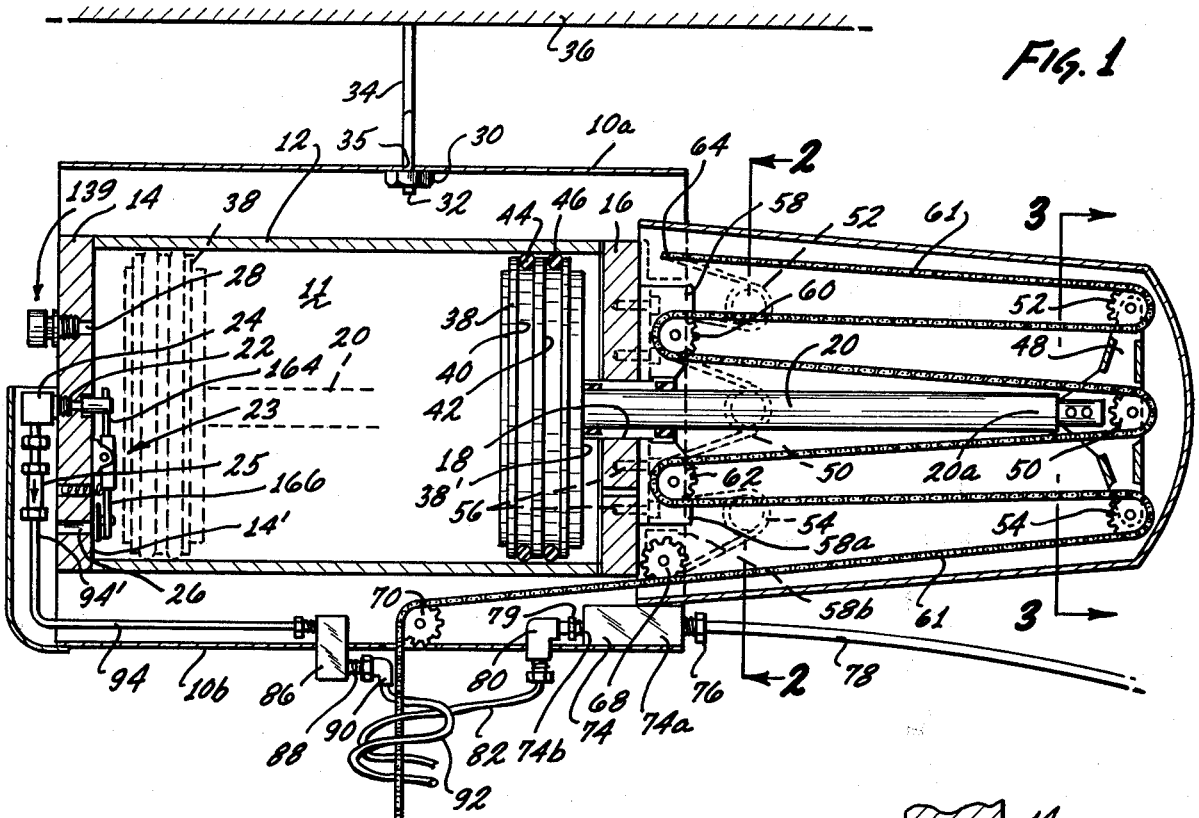
FIG. 1 is a side elevation, partly in section, of the preferred embodiment of the invention.
Figure 2:
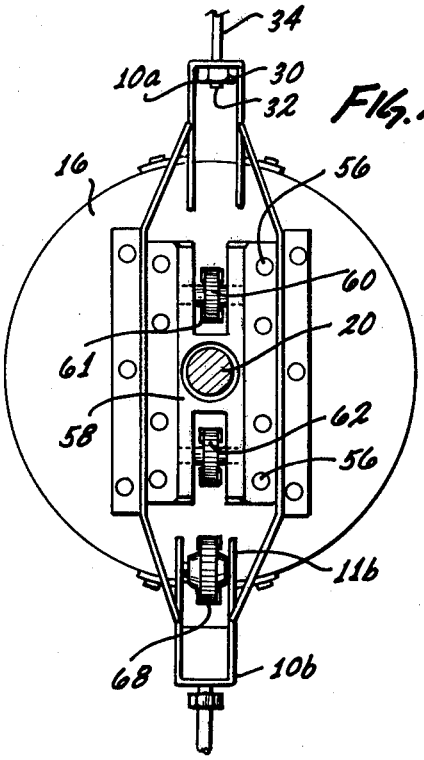
FIG. 2 is an end elevation looking in the direction of the arrows 2—2 along the line extending between the tips of said arrows in FIG. 1.

Referring to FIGS. 1 and 2 of the drawings, the preferred embodiment of the invention may be constructed of a pair of U-shaped members 10*a*,10*b* which bracket, and are secured top and bottom, respectively, to a cylindrical tubing 12, closed at one end by a cap 14, and at the other end, by a cap 16. The latter cap is centrally orificed at 18 to permit a piston rod 20 to be reciprocated therethrough. The cap 14 may also be centrally orificed at 22 and therein threaded to receive a matingly threaded air inlet nipple 24. An additional orifice 26 may be provided for a dump valve; and another orifice 28, for a relief valve. Both of the two latter valves will hereinafter be more fully described.

The unit may be suspended from a transverse member 36 by means of a depending element 34, the lower threaded end 32 of which extends through an orifice 35 in the top wall of the bracket 10*a* and is capped by a nut 30 threaded onto the end 32.

A piston 38 is formed with annular grooves 40 and 42 in which are seated O-rings 44 and 46, respectively, is provided to reciprocate axially within the cylinder 11 formed by the tubing 12 and the end caps 14 and 16. The piston rod 20 is secured centrally to the side 38' of the piston 38. Mounted on the end 20*a* of the piston 20, is a T-shaped member 48 upon which are rotatably disposed symmetrically three sprockets 50, 52 and 54. In addition, sprocket holds 58, 58*a* and 58*b* are secured by screws 56 rotatably to mount sprockets 60 and 62 and a further sprocket 68. A final sprocket 70 is mounted rotatably on the downwardly extending triangulated member 30*a*.

As may be seen from FIG. 1, a chain 61 starting from its anchor point 64 is passed outwardly (to the right in FIG. 1) over the sprocket 52; inwardly back over the sprocket 60; outwardly again over the sprocket 50; inwardly again over the sprocket 62; outwardly to the third and last sprocket 54 on the T-member 48; and then back across the sprocket 68, on the end 11*b* of the member 10*b*, and around a final sprocket 70 to extend downwardly to where the other end 61*a* of the chain 61 may be attached to an elongated cylindrical element or core 72.

Figure 7:
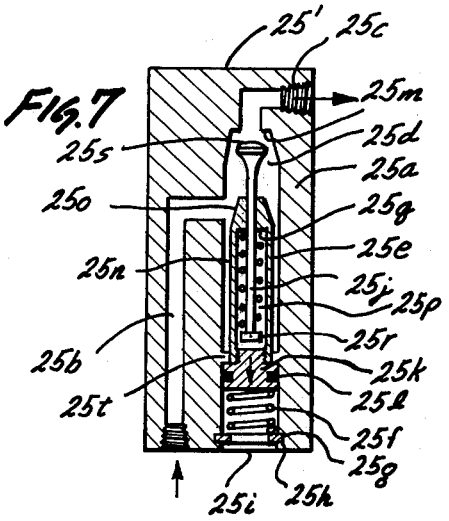
FIG. 7 is an enlarged section of the flow sensor or fail-safe valve shown in FIG. 1.

The member 10*b* may also serve as a means on which may be mounted a double-ended air conduit element 74, one end 74*a* of which may receive the nipple 76 of a hose 78 connected to a source (not shown) of air under pressure. The other end 74*b* of the element 74, is adapted to receive a nipple 79 of an elbow 80 by which an air hose 82 may be connected and passed down to a valve control element, designated generally as 84. Also mounted on the U-shaped member 10*b* may be a further double-ended conduit connector 86, the lower end of which receives the nipple 88 on a fitting 90 at the upper end of a second hose 92, also extending down to the valve control element 84. A metal tube 94 may be provided with the nipple 24 thereby to place the inlet opening 22 in the wall of the cap 14 in air-flow communication with the second hose 92. Desirably a flow sensor 25 should be interposed between the upper end 94' of the tube 94 and the nipple 24. While such a flow sensor 25 might be one of the commercially available types, such as part No. B-4-FS-25Fa, manufactured and sold by The Hansen Manufacturing Company of Cleveland, Ohio, where the balancing hoist might be designed to handle a standard load weight and to operate at a hose air pressure within the range of such Hansen part, if the hoist might be expected to handle varying loads at widely differing hose pressures, such a commercial failsafe or sensor 25 might not be found to operate satisfactorily. Instead, a flow sensor 25', such as that shown in more detail in FIG. 7, would be preferred. Such a sensor is comprised of a body 25*a* having an air entrance passage 25*b* and an air exit passage 25*c* which would be placed in communication with the cylinder air inlet opening 22. A chamber 25*d* is disposed intermediate the air entrance and exit passages 25*b*, 25*c* respectively, and a cylindrical valve passage 25*e* extends from the chamber 25*d* through the valve body to the outside. A coiled spring 25*f* is seated against a split washer 25*g* embedded in an annular recess 25*h* near the mount 25*i* of the passage 25*e*, and biased to press a valve stem 25*j*, through a slidable plug 25*k* sealed by an O-ring 25*b* to dispose its head 25*j'* on the annular land 25*m* constituting the entrance from the chamber 25*d* to the exit passage 25*c*. The valve stem 25*g* may be centered coaxially in the valve passage 25*e* by means of a sleevelike member 25 in having an orificed cap 25*o* through which the stem 25*j* may be passed, and the stem 25*j* may be held resiliently within the sleeve 25*n* by another coiled spring 25*p* one end of which is seated against the inside wall 25*q* of the cap 25*o* and the other end, against a disc 25*r* secured on the inner end 25*s* of the stem 25*j*. The function of any such flow sensor 25 or 25' is automatically to shut off the flow of compressed air through the tube 94 and nipple 24 in the event that a rupture should occur in tube 94 or the air hose 92, in accordance with Federal Safety Regulations.

Figure 4:
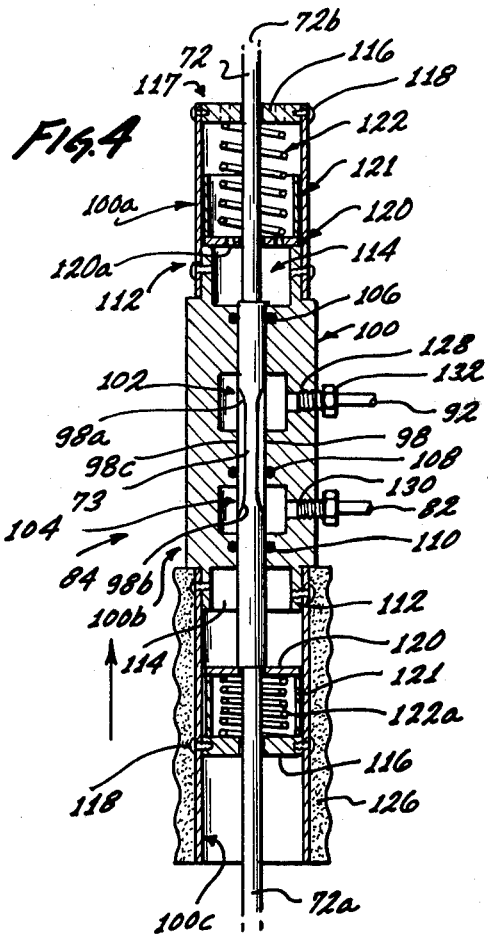
FIG. 4 is an enlargement of the sleeve-like valve shown in FIG. 1 with the sleeve in the "up" position.
Figure 3:
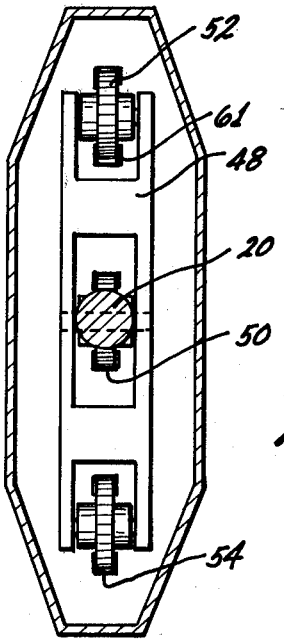
FIG. 3 is an elevation of the sprockets carried at the end of the piston rod as seen from the line 3—3 looking in the direction of the arrows in FIG. 1.

Referring to FIG. 4, the control valve 84 is comprised of the elongated cylindrical core 72 which extends downwardly to its lower end 72*a* to which a hook 96 is attached. The core 72 has a section 73 intermediate its ends 72*a* and 72 *b* which is of a greater diameter than the diameter of the element at its ends. This section 73 is annularly grooved at 98, the groove 98 being somewhat shallow at its extremities 98*a*, 98*b* and deeper at its intermediate area 98*c*. Coaxially surrounding the element 72 for most of its length is a sleeve-like member 100. This member 100 is comprised of three sections, 100*a*, 100*b* and 100*c*. The intermediate section 100*b* has two internal annular groves, 102 and 104, and three annular O-ring receiving grooves 106, 108 and 100. Except in the areas of all of these internal annular grooves, the inside diameter of the section 100*b* is such as to provide a close but slidable fit about the intermediate larger section 73 of the core 72. Projecting axially from each end of the section 73 is a short sleeve-like portion, 112, which is of a lesser outside diameter than the outside diameter of the central portion of section 100*b* and of an inside diameter which is greater than the inside diameter of the ungrooved portion of section 100*b*, thereby to provide an annular space 114 between the annular axial projection 112 and the outer periphery of the core 72. Sections 100*a*, 100*c* of the outer sleeve-like valve member 100 are each a cylindrical sleeve having an inside diameter closely approximating the outside diameter of the annular axial projection 112, to fit tightly thereabout and thereby also to be spaced internally from all sections of the core 72. Each of the sleeves constituting a section 100*a*, 100*c* is held by screws 113 to an axial projection 112. An annular disc 116, with axial orifices 117 and having an outside diameter closely approaching the inside diameter of each of the sleeve sections 100*a*, 100*c* may be secured by screws or pins 118 to the sleeves 100*a*, 100*c* about a core section 72, 72*a* respectively to leave an annular space 119 between the disc 116 and such core sections 100*a*, 100*c*. In addition, an annular washer 120, orificed axially at 120*a*, is provided to seat on the shoulders formed by the ends of the sleeve-like projections 112. A spacer sleeve 121 which may either be formed integrally with the washer 120 or simply loosely interposed between the disc 116 and washer 120, is also placed over the core sections 72, 72*a* and a coiled spring 122, 122*a* is disposed within the sleeves 121 and between the opposing facings of the annular disc 116 and washer 120. An annular rubber handle sleeve 126 may be provided about the sleeve section 100*c*.

The central section 110*b* is provided with threaded orifices 128 and 130 in transverse alignment with the annular grooves 102 and 104, respectively, to communicate therewith and nipples 132 and 134 on the ends of hoses 92 and 82, respectively, are threaded into the orifices 128 and 130, respectively.

Figure 5:
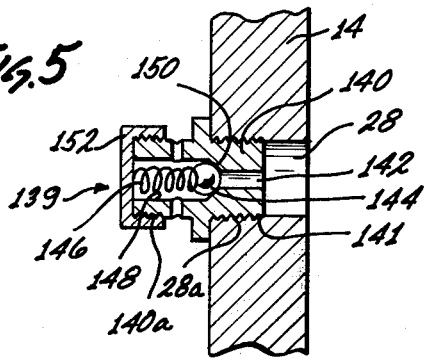
FIG. 5 is an enlarged section of the relief valve shown at the left hand end of the cylinder in FIG. 1.

Referring to FIG. 5, the relief valve 139 which is inserted in the orifice 28 in the end wall 14 of the air cylinder may comprise a fitting 140, having an axial orifice 142. The end of the fitting 140 which is inserted in the orifice 28 may be matingly threaded at 141 with the threading 28*a* in the orifice 28. A ball 144 may be held by a spring 146 in a counter bore 148 against the opening 150 of the axial orifice 142 into the counter bore 158 by a cap 152 which may be threaded onto the end 140*a* of the fitting 140.

Figure 6:
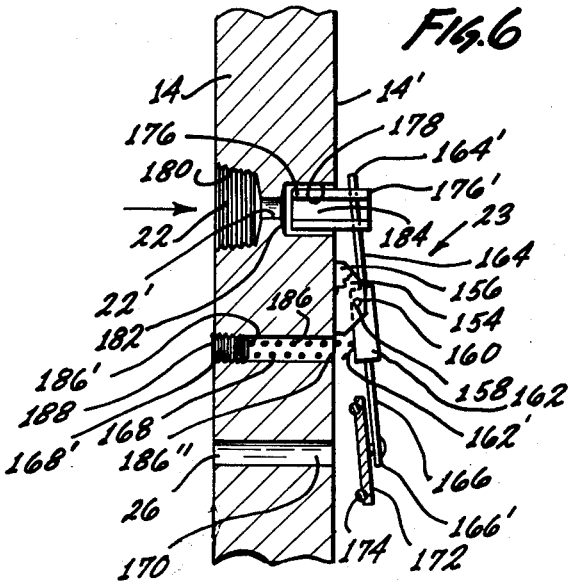
FIG. 6 is an enlarged section of the dump valve also shown at the left hand end of the cylinder in FIG. 1.

The dump valve 23 shown in FIGS. 1 and 6 is disposed on the outside wall 14' of the end cap 14, its assembly being mounted on the inside 14' of the end cap 14 by means of a pair of parallel walls 154, 156 spaced from each other and orificed at 158 in register to permit a trunnion 160 extending laterally from a pivotable member 162 (disposed and fitting between the walls 154, 156). Elements 164 and 166 extend rigidly from each end of the member 162.

The wall 14 is provided with two additional orifices 168 and 170. Mounted on the end 166' of the element 166 is a circular cover 172, the periphery of which may carry a sealing O-ring 174. Toward the end 164' of the oppositely extending element 164 is mounted a sleeve 176 adapted to fit into a counter bore 178 extending in from the side 14' of the end cap 14. The orifice 22, as may be seen in FIG. 6, is actually constituted of a narrow central portion 22', a first counter bore 178, and a second threaded counter bore 180. Where the counter bore 178 joins the narrow orifice portion 22' an annular shoulder 182 is formed. The upper portion 176' of the sleeve 176 is diametrically orificed to permit the end 164' of the element 164 to be passed through the sleeve. The width of the end of the element 164 as it passes through the central opening 184 in the upper end 176' of the sleeve 176, in relation to the inside configuration and dimensions of the sleeve 176 should be such as to provide some obstruction to the flow of pressurized air which passes through the narrow neck portion 22' of the orifice 22 and through the passage 184, as defined by the sleeve 176.

A spring 186 is inserted in the orifice 168 with its end 186' seated on the inner end of a screw 188 inserted in the matingly threaded portion 168' of the orifice 168. The opposite end 168'' of the spring 186 is placed in contact with the righthand underside 162' of the member 162.

In operation, when the load balancing hoist of the present invention is mounted by the element 34 to a carrying transverse member or structure 36 and is connected by its hose 78 to a source of compressed air, a load may be attached to the hook 96 for raising or lowering. If it is desired to raise the load, the operator places his hand upon the grip 126 and moves the grip upwardly relative to the elongated cylindrical element 72, thereby forcing the sleeve-like member 100 in the same direction relative to the cylindrical core 72 until it is stopped by the lower sleeve 121 (about core end 72*a*) becoming pinched between the annular disc 116 and washer 120 in the position shown in FIG. 4. With such relative movement, the annular groove 98 will be disposed to extend at least partially over the two internal annular grooves 102, 104 in the central section 100*b* of the sleeve-like member 100, thereby providing a passage for the compressed air arriving by the hose 82 to enter the hose 92. The compressed air is conducted by this hose 92 through the fitting 90, the fitting 86, the tube 90, flow sensor 25, nipple 24 and orifice 22 into the left-hand end of the cylinder 12. Air moving against sleeve 176 causes element 164 to pivot element 162, to close the circular cover 172 over opening 170 and seal it against air leakage. Air pressure buildup in cylinder 11 thereafter acts against cover 172 to maintain a tight seal about the opening 170 in the wall 14.

Upon the arrival of compressed air in the left-hand end of the cylinder 11, the piston 38 will be forced to the right-hand end of the cylinder 11, and with it, piston rod 20 will be moved to the right. The outer end of the rod 20 carries the T-shaped member 48 and its rotatably mounted sprockets 50, 52 and 54. The movement of these three sprockets 60, 62, 68 and 70, results in drawing the chain 60 through its loopings over all of these sprockets to where a much greater portion of the total length of the chain 60 is required for such looping, with the further result that the depending portion of the chain 61*a* is drawn upwardly around the sprocket 70 to pull up the cylindrical element 72 and any load attached to its lower end 72*a* means of the hook 96.

Conversely, when the operator moves the handle 126 downwardly relative to the core 72, against the urging of the upper spring 122*a* (i.e., that about core end 72*b*), the internal annular groove 98 in section 73 of the core 72 will no longer bridge the annular grooves 102 and 104 of the sleeve section 110*b* (thereby shutting off further supply of air to the hose 92), but instead will extend between the groove 102 and the annular space 114, thereby placing the hose 92 in communication with the atmosphere through the orifices 102*a* and 117 in the washer 120 and disc 116 respectively, the annular space 114 and the inner unfilled area defined by the sleeve 121. When this occurs, air begins to be exhausted back through the hose 92 from the cylinder 11. However, with air pressure no longer being maintained in the cylinder 11, there ceases to be provided any force to maintain the cover 172 over the orifice 170 in the wall 14 against the urging of the spring 186 which is acting against the member 62. The latter will then be pivoted about the axis of its trunions 160 back to the position shown in solid lines in FIG. 6 to lift the circular cover 172 from the relief orifice 170. When the circular cover 172 is so lifted from over the orifice 170, the remaining air under pressure in the cylinder 11 may immediately escape through the orifice 170.

It should now be appreciated that with the exhaustion of air under pressure from that part of the cylinder 11 which is to the left of the piston 38, as shown in FIG. 1, the piston 38 is now free to move back toward the left side of the cylinder and such movement will be caused by any substantial downward force applied to the depending end 61*a* of the chain 61 through the element 72 and/or hook 96. Any such downward force so applied by the depending end of the chain 61*a* through the sprockets 52, 50, 54, 60, 62, 68 and 70, will tend to shorten that portion of the chain 31 which is looped over said sprockets, thereby driving the piston rod 20 and its piston 38 to the left, and ultimately to the dotted line position shown in the left-hand side of the cylinder 11. Thus, the raising and lowering on any load secured to the hook 96 may be easily controlled by an operator simply by placing one of his hands around the handle grip 126 and pushing the handle upwardly or downwardly, respectively. The tapering at 96*a* and 96*b* of the annular groove 98 provides a considerable degree of attenuation in control in the raising and lowering of the load. In addition, as hereinabove explained, because of the friction in the system, the load may be shifted upwardly or downwardly to a limited degree without the operator actually shifting the valve at all. This is done by the operator simply applying a small lifting or downward force to the load. Thereby the load may be gently placed in a desired final disposition.

In the event of any rupture of any of the air hoses which would create a sudden loss of air pressure in the tube 94, the flow sensor 25 or 25′ will act to shut off any flowback of air from the cylinder 11. In the case of the fail-safe or sensor 25′ shown in FIG. 7, such shut-off occurs in this manner: When air under pressure enters the entrance passage 25*b* in the body 25*a* and passes through the chamber 25*d* to the air exit passage 25*c*, such air pressure will be sufficient to force the slidable plug 25*k* downwardly against the spring 25*f* to carry with it the sleeve 25*n* and pull the valve stem head 25*j*′ off the annular land 25*m* on which, in the absence of any air pressure in the chamber 25*d*, such head 25*j*′ would normally be seated. Thereby, the valve 25′ will be disposed in the position shown in FIG. 7 so that air can flow freely through the chamber 25*d* and air exit passage 25*c* into the cylinder 11. However, should the air supply entering the passage 25*b* be suddenly cut off through a rupture of the hose or otherwise, pressure will no longer be maintained in the chamber 25*d* and valve passage 25*e* to hold the slidable plug 25*k* downwardly against the urging of the spring 25*f*. The latter will thereupon move the plug upwardly to where the valve stem head 25*j*′ seats on the land 25*m* — even against a certain degree of initial back pressure from the cylinder 11 which would tend to force air from the cylinder 11 back out of the air exit passage 25*c*. With such valve closure, then, any rapid exhaustion of air from the cylinder 11 would be prevented which rapid exhaustion might otherwise cause a heavy load on the hook 96 to drop so rapidly as to endanger the operator, the load and any equipment or machine above which the load was being manipulated by the hoist.

On the other hand, should there somehow occur a build-up of an excess of air pressure in the cylinder 11 beyond a predetermined amount, the ball 144 in the relief valve 139 will be forced outwardly against the spring 146 to cause a bleed-off of such pressure excess in the cylinder 11.

While the embodiment of the invention illustrated in FIG. 1 of the drawings is shown to provide a lateral movement of the piston 38, the piston rod 20, and the sprockets 50, 52 and 54, it will be appreciated by those skilled in the art that the same structure could be utilized with only slight modifications to provide a vertical movement below the cylinder. However, the embodiment as illustrated in FIG. 1 is to be preferred.

Also, although the embodiment shown and specifically discussed provides sprockets and chains, the same principles of construction could be applied to a hoist utilizing spools and cables, although the latter have a tendency to twist undesirably so that sprockets and chains are to be preferred.

We claim:

1. An air pressure hoist having a load balancing capability, said hoist comprising:

an air cylinder closed at both ends, except for a centrally disposed opening in one of its ends, said cylinder having means to support it from a structure;

a piston reciprocable in said cylinder, said piston having a rod extending from one side thereof through said opening in the one end of the cylinder, to reciprocate with said piston;

an air inlet passage in one end of said cylinder;

at least two first sprocket means, said first sprocket means being rotatably disposed upon a portion of the piston rod which, when the rod is reciprocated with the piston, does not pass in and out of the cylinder;

second sprocket means, said second sprocket means being rotatably disposed at a fixed location adjacent the outside of the one end of the cylinder having the centrally disposed opening therethrough;

chain means, one end of said chain means being anchored fixedly in the vicinity of a side of the outside of said one end of the cylinder having the opening therethrough, said chain means extending from its anchor point around one of said first sprocket means, back toward and around said second sprocket means, again back toward and around the other of said first sprocket means and downwardly below said cylinder to terminate in a depending end;

air control valve means, said valve means comprising an inner elongated cylindrical body and an outer sleeve slidable relative to said body, said body being secured at its upper end to the depending end of said chain to itself depend from the chain and further being disposed along a vertical axis, the lower end of said body being provided with means to carry a load;

said sleeve having an air inlet port, an air outlet port and an air bleed passage to the atmosphere, said air inlet port being in communication with a source of air under pressure; said air outlet port being in communication with the air inlet passage in said one end of said cylinder;

said body having air passage means whereby, when said sleeve is shifted upwardly relative to said body to a first position, said air inlet port in the sleeve is placed in communication with its air outlet port, thereby delivering air to the cylinder to drive its piston toward that end of the cylinder with the centrally disposed opening, and through the movement of the piston rod and its carrying the said first sprocket means and chain means away from the last said cylinder end, raising the dependent end of the chain means, the air control valve means and any load carried by the means to carry such load; and when said sleeve is shifted downwardly relative to said body to a second position, said air outlet port is placed in communication with said bleed passage, thereby to remove air pressure from the cylinder so that the piston may be forced back by the weight of the load on the dependent end of the chain, acting upon the first and second sprocket means, towards the opposite end of the cylinder from that having the central opening; and spring means in said air control valve to bias said sleeve to a third position intermediate said first and second positions.

2. The air pressure hoist as described in claim 1 wherein the air cylinder is disposed with its axis extending horizontally.

3. An air pressure hoist as described in claim 2 wherein a first triangulated plate is secured by one of its sides to the topside of the cylinder, and a second triangulated plate is similarly secured to the bottom side of said cylinder, both said plates being disposed in a vertical plane passing through the cylinder axis, the apex of the first triangulated plate being orificed to serve as the means to suspend the cylinder from the structure, and the lower triangulated plate rotatably supporting third sprocket means over which the chain means is passed from the first sprocket means to depend below the cylinder and its second said triangulated plate.

4. The hoist as described in claim 3 wherein a transverse plate is provided on the outer end of the piston rod, said plate serving to carry three of said first sprocket means, said second sprocket means comprising a pair of sprockets, one above and one below the piston rod, and said chain means extending over all of said sprockets and finally around the third spocket means to depend below the cylinder.

5. The hoist as described in claim 3 wherein U-shaped channel members are provided to extend across the top and bottom sides of said cylinder to be secured to said cylinder, the upper member being orificed to permit said cylinder to be suspended from said structure, and the lower channel member being orificed to permit air conduits to pass therethrough, rotatably to mount said third sprocket means and being further orificed to permit the chain means to extend downwardly from said third sprocket means to the dependent position of said chain.

6. The hoist as described in claim 5 wherein housing means are provided to extend from the end of said cylinder having said centrally disposed opening past the limit of travel of the outer end of said piston on which said first sprocket means are mounted.

7. The hoist as described in claim 2 wherein third sprocket means are rotatably provided below the cylinder in approximate vertical alignment with the center of gravity in the cylinder.

8. The hoist as described in claim 1 wherein the air inlet passage is disposed in that end of the cylinder which is opposite the end having a centrally disposed opening.

9. The hoist as described in claim 1 wherein the air passage means in the elongated cylindrical body of the air control valve means comprises peripheral recessing in said body.

10. The hoist as described in claim 9 wherein the peripheral recessing in said elongated cylindrical body which comprises the air passage means, are annular grooves about said body.

11. The hoist as described in claim 10 wherein the annular grooves have tapering edges to provide better attenuation in the control of the air flow to and from the cylinder.

12. The air pressure hoist as described in claim 1 wherein said spring means comprises a pair of coiled springs, each disposed in the vicinity of one end of and extending around said cylindrical body, the outer end of each said spring being held with reference to a fixed point on said body near its extremity, and the inner end of said spring bearing upon a portion of said outer sleeve slidable relative to said body.

13. The hoist as described in claim 1 wherein the cylinder is provided in its end opposite that with the centrally disposed opening with a bleed valve which opens to permit air to pass out of said cylinder in response to a predetermined drop in the air pressure in said cylinder.

14. The hoist as described in claim 1 wherein there is provided in the end of said cylinder opposite that having the centrally disposed opening, a relief valve, said relief valve opening in response to a pressure value exceeding a predetermined amount, to permit pressurized air in said cylinder to pass through said relief valve until the pressure in said cylinder drops back to said predetermined amount.

15. An air pressure hoist as described in claim 1 wherein the air inlet port of said cylinder is placed in communication with the air outlet port of said sleeve by an air tube conduit, said conduit having fail-safe means at its end adjacent the inlet port of the cylinder, whereby any sudden drop of pressure in the conduit will partially close the conduit passage to thereby permit pressurized air in the cylinder to be bled from the latter at a lesser predetermined rate.

* * * * *